US008381768B2

(12) United States Patent
Hasegawa et al.

(10) Patent No.: US 8,381,768 B2
(45) **Date of Patent: *Feb. 26, 2013**

(54) JOINT FOR FLUID CONTAINER

(75) Inventors: Toru Hasegawa, Kanagawa (JP); Toshiki Takedutsumi, Kanagawa (JP); Masahiro Hasunuma, Saitama (JP)

(73) Assignees: Tokyo Ohka Kogyo Co., Ltd., Kanagawa (JP); Surpass Industry, Co., Ltd., Saitama (JP)

( * ) Notice: Subject to any disclaimer, the term of this patent is extended or adjusted under 35 U.S.C. 154(b) by 1245 days.

This patent is subject to a terminal disclaimer.

(21) Appl. No.: 12/162,245

(22) PCT Filed: Nov. 7, 2006

(86) PCT No.: PCT/JP2006/322180

§ 371 (c)(1),
(2), (4) Date: Jul. 25, 2008

(87) PCT Pub. No.: WO2007/088661

PCT Pub. Date: Aug. 9, 2007

(65) Prior Publication Data

US 2009/0020176 A1 Jan. 22, 2009

(30) Foreign Application Priority Data

Jan. 31, 2006 (JP) ..... 2006-023763

(51) Int. Cl.
*F16K 24/00* (2006.01)

(52) U.S. Cl. ..... 137/588; 137/212; 251/149.6

(58) Field of Classification Search ..... 251/149.6, 251/144; 137/212, 588, 206; 222/407, 105, 222/386.5, 464.1

See application file for complete search history.

(56) References Cited

U.S. PATENT DOCUMENTS 5,335,821 A 8/1994 Osgar (Continued)

FOREIGN PATENT DOCUMENTS

| | | |
|---|---|---|
| JP | 6100087 | 4/1994 |
| JP | 2001192099 | 7/2001 |
| JP | 2003172487 | 6/2003 |

OTHER PUBLICATIONS

International Search Report for PCT/JP2006/322180, completed Jan. 23, 2007.

Office Action issued to CN Application No. 200680051259.2, issued Jul. 31, 2009.

*Primary Examiner* — John K Fristoe, Jr.
*Assistant Examiner* — Andrew J Rost
(74) *Attorney, Agent, or Firm* — Hoffmann & Baron, LLP

(57) ABSTRACT

A joint for duplex storage type fluid container that can attain secure fitting of a liquid discharge tube and can attain easy, secure connection of a passage for fluid emission disposed in a dispenser to the liquid discharge tube. There is provided a joint for fluid container comprising flexible bag (12) furnished with neck part (11) openable for permitting injection of liquid and comprising outside container (13) formed so as to support the neck part (11) by mouth part (13*a*) and accommodate the bag (12), which joint is so structured that liquid discharge tube (15) with collar part (15*a*) can be fitted through plug (14) to the mouth part (13*a*) of the outside container (13), and further so structured that flow channel (21*a*) fitted to dispenser (2) can be linked directly to fluid passage (15*b*) of the liquid discharge tube (15).

7 Claims, 6 Drawing Sheets

U.S. PATENT DOCUMENTS 5,957,328 A * 9/1999 Osgar ..... 222/1
6,015,068 A * 1/2000 Osgar et al. ..... 222/400.7
6,302,148 B1 * 10/2001 Imai ..... 137/614.04
6,425,502 B1 * 7/2002 Rauworth et al. ..... 222/400.7
6,568,427 B2 * 5/2003 Imai ..... 137/590
6,634,396 B2 * 10/2003 Ozawa ..... 141/326
8,052,014 B2 * 11/2011 Hasegawa et al. ..... 222/400.7

* cited by examiner

JOINT FOR FLUID CONTAINER

CROSS-REFERENCE TO RELATED APPLICATIONS

This application is the National Stage of International Application No. PCT/JP2006/322180, filed Nov. 7, 2006, which claims the benefit of Japanese Application No. 2006-023763, filed Jan. 31, 2006, the contents of both of which are incorporated by reference herein in their entirety.

FIELD OF THE INVENTION

The present invention relates to a joint for a container for storing, transporting and distributing fluids such as chemicals for the electronics industry. Specifically, the present invention relates to a joint structure of a container for draining fluids.

BACKGROUND OF THE INVENTION

For example, chemicals for the electronics industry such as photo-resist are stored in a chemical container for transport, and are delivered to a factory. Such a chemical container is used in a linking configuration by which the same container is repeatedly used, or in a one way configuration by which a new container is used each time. Particularly, it is preferable to use the container in the one way mode in order not to affect the degree of purity of a high-purity chemical; however, the one way mode has an economic disadvantage. In recent years, a dual storage system-type container, which combines both of the above described modes, has been popular.

Generally, the dual storage system-type container has a bag (pouch) consisting of a flexible film which has been washed in advance. This film bag is formed of an inert material and is provided in an outer container. After the chemical is drained from the film bag, this film bag is disposed of, and a new film bag is filled with a chemical. The outer container including the joint and the like is used repeatedly.

In a way such as a dual storage system-type container, a container for liquid chemicals has been invented, which makes it possible to safely and securely drain liquid chemicals (for example, see Patent Document 1).

Patent Document 1: Japanese Unexamined Patent Application Publication No. H06-100087

SUMMARY OF THE INVENTION

FIG. 5 is a cross-sectional view of a top end of the container according to Patent Document 1, in a state in which a cap is attached. FIG. 5 of the present application corresponds to FIG. 3 of Patent Document 1. In addition, FIG. 6 is a cross-sectional view of the top edge of the container according to Patent Document 1, in a state in which the container and the dispenser are assembled. FIG. 6 of the present application corresponds to FIG. 6 of Patent Document 1.

In FIG. 5 and FIG. 6, the container according to Patent Document 1 includes a container 7 and a dispenser 8. The container 7 includes an outer container 716 having a port (hereinafter referred to as a mounting body) 718, a liquid pouring tube 722 having a fluid passage 780, and a coupling 724. The coupling 724 is provided at a top edge of a tube 794 so that the coupling 724 is inserted into the mounting body 718. The coupling 724 has a void space 776 provided at the top edge thereof, and a fluid passage that connects the void space 776 to a fluid passage 780 of the tube 794.

The container 7 further includes a ventilation passage 782 that ventilates gas between the inside of the outer container

716 and the void space 776, and a breakable seal 727 that is provided on the top end of the mounting body 718. The dispenser 8 can be inserted into the void space 790 through the seal 727, and includes a probe 846 having a fluid passage 844. Moreover, a compressed fluid passage is provided, which is connected to the probe 846 and accommodates liquid chemicals that are drained from the outer container 716 through the tube 794, the coupling 724, and the fluid passage 844 of the probe 846.

In FIG. 5 and FIG. 6, the outer container 716 has a mouth portion 730 on which external threads are formed, and a retainer 719 and the mounting body 718 are attached inside the mouth portion 730. The container 7 is provided with a bag 720 consisting of a flexible film inside the outer container 716. After the mounting body 718, to which the bag 720 has been attached, is attached to the mouth portion 730 of the outer container 716, the bag 720 is inflated, preferably with nitrogen or compressed air, before the bag 720 is filled with liquid chemicals. Subsequently, the bag 720 is filled with the liquid chemicals through the mounting body 718. Thereafter, the liquid pouring tube 722 and the coupling 724 of the liquid pouring tube 722 are inserted into the mounting body 718. A cover 726 positions a breakable seal 727 on the top end of the mounting body 718, thereby sealing the void space 776. Moreover, it is possible to cover the breakable seal 727 by providing a cap 728 to the mouth portion 730 of the container 7.

During the transport and handling of the container 7, all of the gas generated in the flexible bag 720 can flow through a gas passage formed by the coupling 724 of the liquid pouring tube 722, and can stay in the void space 776 that is provided at the top edge of the coupling 724 of the liquid pouring tube 722.

The container 7 according to Patent Document 1 includes the breakable seal 727. Accordingly, the probe 846 provided in the dispenser 8 breaks through the seal 727, thereby making it possible to insert the probe 846 into the void space 790 (see FIG. 6). However, there is a problem, at this time in that fracture pieces of the seal 727 may mix in the bag 720 through the void space 790 (see FIG. 5). Moreover, there has been concern regarding a case in which an operator can not properly break through the seal, causing clogging of the probe, thereby disabling the connection. It is possible to eliminate the aforementioned problem by achieving a joint structure by which the dispenser is connected to the container without the use of a breakable seal. In addition, it is more preferable if a one-touch connection to the container is made possible without threading to the dispenser.

Moreover, the container 7 according to Patent Document 1 is an assembly whereby the liquid pouring tube 722 and the coupling 724 are configured as separate units and one end of the liquid pouring tube 722 is pressed into to the coupling 724 (see FIG. 5). This liquid pouring tube 722 with the coupling 724 is reused after cleaning; however, there has been trouble in reassembling (press fitting) after disassembling and cleaning in order to remove chemicals that have seeped into the gaps of the press fit points. It is possible to eliminate such trouble by integrating the coupling and the liquid pouring tube into one body.

In addition, in FIG. 5 and FIG. 6, an edge 787 is formed on a top edge of the coupling 724 as a diameter which is slightly larger than the external diameter of the coupling 724. Accordingly, there has been a risk in that the tube 722 with the coupling 724 may get past a step provided to the void space 776 of the mounting body 718, thereby falling into the bag 720. A joint structure is demanded which makes it possible to easily attach the liquid pouring tube to the container independent of the operator adjusting the force. However, these are the problems to be resolved by the present invention.

The present invention has been made in view of such problems. It is an object of the present invention to provide a joint for a dual storage system-type fluid container, which includes a bag made of a flexible film inside an outer container, to which a liquid pouring tube can be securely attached, and in which a liquid discharging passage formed in a dispenser is easily and securely connected to the liquid pouring tube.

The inventors nave configured a joint for a fluid container such that a liquid pouring tube having a collar portion can be attached to a mouth portion of an outer container through a plug, and further configured the fluid container such that a duct provided to a dispenser can be directly connected to a fluid passage of the liquid pouring tube. Based on this, the inventors have invented the following new joint for a fluid container.

In a first aspect of the present invention, a joint for a fluid container is provided to which a dispenser is connected, the fluid container including: a flexible bag having a neck portion that is open for making it possible to pour liquid; and an outer container that supports the neck portion with a mouth portion and that accommodates the bag, in which the fluid container further includes: a cylindrical plug held by the mouth portion, the plug having a substantially cylindrical header portion protruding from a cylindrical bottom at a first end, a cylindrical portion fitting into an orifice of the neck portion at a second end, and a through hole penetrating from the first end to the second end; a liquid pouring tube having a collar portion adhered to a top face of the header portion at the first end, with the second end being inserted into the through hole, in which the liquid pouring tube has a fluid passage extending from the first end to the second end, and in which liquid in the bag is drained through the fluid passage; a first ventilating means for ventilating gas from an inside of the outer container to the mouth portion, in which the first ventilating means has a plurality of first orifices provided at a bottom of the neck portion, the plurality of first orifices communicating from an inside of the outer container to an inside of the neck portion, and has a plurality of second orifices communicating from a perimeter of the cylindrical portion to the top face of the header portion; and a second ventilating means for ventilating gas from the inside of the bag to the mouth portion, in which the second ventilating means has a plurality of third orifices provided to the collar portion, the plurality of third orifices communicating from the mouth portion to an inside of the through hole; in which the dispenser includes: a socket main body having a cylindrical outer cylinder; a valve mechanism which is constructed inside the socket main body, and which causes the axially penetrating duct to be discontinuous; a sleeve held on the outer perimeter of the orifice side of the socket main body; a sleeve having a releasably lockable locking mechanism so as to cover the header portion; and a means for receiving liquid distributed from the bag through a fluid passage of the liquid pouring tube and the duct of the valve mechanism, in which the valve mechanism is biased to and adheres to the first end of the liquid pouring tube.

According to the first aspect of the present invention, the joint for a fluid container is connected with a dispenser, and the fluid container includes a flexible bag and an outer container. The bag has a neck portion that is open for making it possible to pour liquid. The outer container makes it possible to accommodate the bag with the neck portion supported by a mouth portion.

The bag is configured with a pouch of a flexible film formed with an inert material and the neck portion consisting of relatively rigid synthetic resins, in which the neck portion is bonded to an end portion of the pouch. The bag is washed in advance, and is accommodated in the outer container. After draining the liquid from the bag, the bag with the neck portion is discarded, and a new bag with a neck portion is accommodated in the outer container. This fluid container is a dual storage system-type container, in which the outer container is repeatedly used, and in which a new bag is used every time.

It is preferable that the outer container be constructed with a strong material in order to make it possible to be used repeatedly. By way of such an outer container, it is possible to use a metal drum which is made by forming and welding stainless steel; however, it is not limited to a metal drum, and other materials including a synthetic resin may be used. A steel storage drum is preferably used as the outer container, the steel storage drum being configured with a base plate, a side wall with a bracelet, and a top plate which bulges in the middle thereof. As for the outer container, external threads are formed, on the mouth portion (also referred to as a mouth plug), and a pair of molded handles may be provided thereto to facilitate transport.

Here, a flange is formed at an orificial side of the neck portion, while a step is provided at an inner wall of the mouth portion, in which this flange engages with the step supports the neck portion to the mouth portion. The bag is accommodated in the outer container, the neck portion attached to the bag is supported by the mouth portion of the outer container, and thereafter, the bag is expanded preferably with nitrogen or compressed air. Subsequently, liquid is poured through an orifice of the neck portion into the bag.

Moreover, the joint for a fluid container according to the first aspect of the present invention includes a cylindrical plug and a liquid pouring tube. The plug is held at the mouth portion. Moreover, the plug has a substantially cylindrical header portion at the first end, and has a cylindrical portion at the second end. In addition, the plug has a through hole penetrating from the first end to the second end. The header portion protrudes from within a cylindrical bottom of the plug. The cylindrical portion fits in the orifice of the neck portion. The liquid pouring tube has, in the first end thereof, a collar portion adhered to a top face of the header portion. Moreover, the second end of the liquid pouring tube is inserted into the through hole of the plug. The liquid pouring tube has a fluid passage extending from the first end to the second end, and the liquid in the bag is drained through the fluid passage.

The external diameter of the plug is slightly smaller than the inner diameter of the neck portion, and the plug fits in the neck portion supported by the mouth portion. A flange, which has an external diameter that is slightly smaller than the inner diameter of the mouth portion, is provided to a first end of the plug, and an O-ring may be supported by this flange, thereby sealing up the mouth portion. A cover, which is to be described later, is fastened to the mouth portion, thereby holding the plug in the mouth portion together with the neck portion. A predetermined gap is provided between a bottom external wall of the plug and a bottom inner wall of the mouth portion. As a result, it is possible to ventilate gas between first orifices (to be described later) provided at the bottom of the neck portion and second orifices (to be described later) provided at the plug.

The cylindrical portion protrudes from the bottom of the plug, and the cylindrical portion fits in the orifice of the neck portion. For example, an O-ring is supported inside the orifice of the neck portion, and this O-ring adheres to the outer perimeter of the cylindrical portion, thereby making it possible to seal the gas in the bag. The fact that the through hole penetrates from the first end to the second end of the plug indicates that the through hole penetrates from the top edge of the header portion to the bottom edge of the cylindrical portion, and the liquid pouring tube is inserted into this through hole. In order to make it possible to ventilate gas through third orifices (to be described later), a gap is preferably provided between the through hole and the outer perimeter of the liquid pouring tube.

The joint for a fluid container according to the first aspect of the present invention includes a first ventilating means for ventilating air from the inside of the outer container to the mouth portion; a second ventilating means for ventilating air from the inside of the bag to the mouth portion; and a sealing means for sealing the mouth portion. The first ventilating means has the plurality of first orifices and the plurality of second orifices. The plurality of first orifices is provided at the bottom of the neck portion and communicates the inside of the outer container to the inside of the neck portion. The plurality of second orifices communicates the perimeter of the cylindrical portion to the top face of the header portion. The second ventilating means has the plurality of third orifices. These third orifices are provided to the collar portion of the liquid pouring tube, and communicate the mouth portion to the inside of the through hole of the plug.

For example, the fluid container includes a sealing means, and when the sealing means is attached to the fluid container, prevents both liquid and gas from flowing out of the mouth portion. Moreover, when the sealing means is removed, the gas in the outer container and the gas in the bag escape through the first and second ventilating means, respectively, to the outside, before the liquid in the liquid pouring tube is drained to the mouth portion.

The first orifices may be through holes formed at the bottom of the neck portion, and are provided around the orifices of the neck portion into which the cylindrical portion is inserted. The first orifices substantially communicate the internal space of the outer container to the gap provided between the plug and the mouth portion. The second orifices may be slits penetrating from the perimeter of the cylindrical portion to the top face of the header portion, and are provided between the cylindrical portion and the header portion. The second orifices substantially communicate the gap, which is provided between the plug and the neck portion, to atmospheric air.

The third orifices may be through holes formed at the collar portion of the liquid pouring tube, and penetrate from the top surface of the collar portion to the perimeter of the tube. For example, the O-ring is supported on the under surface of the collar portion, and this O-ring adheres to the top face of the header portion, thereby sealing the through hole. The third orifices substantially communicate the gap, which is provided between the inner wall of the through hole and the external wall of the liquid pouring tube, to atmospheric air. It should be noted that, as explained above, this gap can ventilate the internal space of the bag.

The sealing means is a cap, in which the cap includes a cap body and a bushing, the cap body screws to the cover and the bushing protrudes to an inside of the cap body, and in which the bushing includes an O-ring which adheres to the surface of the collar portion to seal ventilation from the fluid passage. The sealing means including this O-ring makes it possible to prevent both liquid and gas from flowing out of the mouth portion.

Moreover, when the sealing means is removed, the gas in the outer container and the gas in the bag escape through the first and second ventilating means, respectively, to the outside of the mouth portion, before the liquid in the liquid pouring tube is drained to the mouth portion. This makes it possible to prevent the liquid in the liquid pouring tube from being drained to the outside of the mouth portion.

The fluid container is completely different from the conventional structure according to Patent Document 1. The fluid container according to the first aspect of the present invention does not include an equivalent of "a coupling 724" at the top edge of "a liquid pouring tube 722" as well as an equivalent of "a void space 776" residing at the top edge of "a coupling 724", which is "the void space 776 connected to a fluid passage 780 of the liquid pouring tube 722 in Patent Document 1 (see FIG. 5 and FIG. 6).

In the case of the conventional fluid container according to Patent Document 1, the gas in the liquid pouring tube and the gas in the bag communicate with each other through the void, space. Accordingly, even if the inside of the outer container is pressurized and the bag shrinks, the pressure in the liquid pouring tube and the pressure in the bag equilibrated with each other. Therefore, when the sealing means is removed, the gas in the outer container and the gas in the bag escape through the void space to the outside, before the liquid in the liquid pouring tube is drained to the mouth portion.

On the other hand, in the fluid container, the gas in the liquid pouring tube, the gas in the outer container, and the gas in the bag are sealed individually by way of the sealing means. When the sealing means is removed, the pressure in the liquid pouring tube, the pressure in the outer container, and the pressure in the bag promptly equilibrate with atmospheric pressure. This makes it possible to prevent the liquid in the liquid pouring tube from being drained to the outside, of the mouth portion.

On the other hand, in the case of the joint for a fluid container according to the first aspect of the present invention, the dispenser includes a socket main body, a valve mechanism, and a sleeve. The socket main body has a cylindrical outer cylinder. The valve mechanism is constructed inside the socket main body, and causes the axially penetrating duct to be open and closable. The sleeve is held on the outer perimeter of the orifice side of the socket main body. Moreover, the sleeve has a releasably lockable locking mechanism so as to cover the header portion. In addition, the dispenser includes a means for receiving liquid distributed from the bag through a fluid passage of the liquid pouring tube and the duct of the valve mechanism, in which the valve mechanism is biased to and adheres to the first end of the liquid pouring tube.

For example, as described later, the valve mechanism may include a valve provided in the duct, an inner sleeve, a helical compression spring, and a coupling seat. The valve is arranged in the duct, and has a valve at the tip end, and the bottom is fixed to the socket main body. As for the inner sleeve, the inside forms a portion of the duct, and a shank forms a retractable bellows. Furthermore, a first end of the inner sleeve has a seat portion open and closable by the valve, and a second end of the inner sleeve fixed to the socket main body. The helical compression spring applies a force so that the inner sleeve extends. The coupling seat bonds to the side of the seat portion of the inner sleeve, and is biased to and adheres to the first end of the liquid pouring tube. The locking mechanism may be, as described later, a so-called ball catch using balls as a locking element, and the sleeve releasably engages with the header portion of the plug so as to cover it.

As for the dispenser, the duct in the valve mechanism is usually blocked with the seat portion abutting the valve. When the socket main body is inserted into the plug, the valve mechanism is biased to the first end of the liquid pouring tube and adheres to the top face of the liquid pouring tube. In addition, when the socket main body is inserted, the seat portion separates from the valve, whereby the duct in the valve mechanism becomes passable. In a state where the sleeve is locked to the header portion, the fluid passage of the liquid pouring tube couples directly to the duct of the valve mechanism, thereby making it possible to receive liquid distributed from the bag.

The joint for a fluid container according to the first aspect of the present invention does not use the breakable seal shown in Patent Document 1. Thus, it is possible to avoid a case in which the probe provided to the dispenser breaks through the seal, causing fracture seal pieces to mix into the bag. Moreover, a concern is eliminated regarding a case in which an operator can not properly break through the seal, causing clogging of the probe, disabling the connection. In this way, the container according to the first aspect of the present invention achieves a joint structure with which the dispenser is connected to the container, without the use of the breakable seal.

In a second aspect of the joint for fluid container as described in the first aspect of the present invention, the liquid pouring tube joins a tube in the middle from the first end having the collar portion to the second end.

For example, it is possible to heat weld the liquid pouring tube to the tube in the middle from, the first end having the collar portion to the second end, by means of ultrasonic oscillation. In the case of the joint for a fluid container according to the second aspect of the present invention, the liquid pouring tube is integrated into the main body. This makes it possible to save the trouble of eliminating chemicals seeping into the gaps of press fit points of the liquid pouring tube as a conventional separate body.

In a third aspect of the joint for a fluid container as described in the first or second aspect, of the present invention, a toric cover is threaded in the mouth portion, in which the toric cover holds the neck portion and the plug to the mouth portion, In a fourth aspect of the joint for a fluid container as described in any one of the first to third aspects of the present invention, the dispenser communicates with a second orifice of the first ventilating means, and a gas passage, to which a pressurized fluid is supplied, is provided between the socket main body and the valve mechanism.

The gas passage may be a plurality of slits formed in the inner wall of the outer cylinder of the socket main body. Regarding these slits in a locked state, a first end of each communicates with the second orifices of the first ventilating means, and a second end of each is connected to a supply port provided to the dispenser.

In a fifth aspect of the joint for a fluid container as described in the fourth aspect of the present invention, when a pressurized fluid is supplied between the bag and the outer container through the gas passage, the bag shrinks and liquid is distributed from the bag through a fluid passage of the liquid pouring tube and the duct of the valve mechanism.

In a sixth aspect of the joint for fluid container as described in any one of the first to fifth aspects of the present invention, the valve mechanism includes: a valve body which is arranged in the duct, and which has a valve at the tip end, and the bottom is fixed to the socket main body; an inner sleeve, in which an inside forms a portion of the duct, a shank forms a retractable bellows, a first end has a seat portion open and closable by the valve, and a second end is fixed to the socket main body; a helical compression spring, which is arranged inside the inner sleeve, and which applies a force so that the inner sleeve extends; and a coupling seat, which bonds to a seat portion side of the inner sleeve, and which is biased to and adheres to the first end of the liquid pouring tube.

In a seventh aspect of the joint for a fluid container as described in any one of the first to sixth aspects of the present invention, the locking device further includes: a plurality of balls which is arranged in an inner circumference of an orifice side of the sleeve; a ball retainer for holding the plurality of balls, which is provided with a plurality of fitting holes permitting only movement in which the plurality of balls move axially as well as move outward and inward in an outer perimeter direction; and a slide ring, which is arranged between the socket main body and the sleeve, and which biases the plurality of balls to the orifice side of the sleeve, thereby pressing the plurality of balls to a direction in which the diameter reduces, and in which a circular locking groove, which locks the plurality of balls, is provided to the header portion of the plug, thereby releasably connecting the dispenser to the container.

In the joint for a fluid container according to the seventh aspect of the present invention, the locking mechanism includes the plurality of balls, a ball retainer, and a slide ring. The plurality of balls is arranged in the inner circumference of the orifice side of the sleeve. The ball retainer holds the plurality of balls. Moreover, the ball retainer is provided with a plurality of fitting holes permitting only movement in which the plurality of balls move axially as well as move outward and inward in the outer perimeter direction. The slide ring is arranged between the socket main body and the sleeve. The slide ring biases the plurality of balls to the orifice side of the sleeve, thereby pressing the plurality of balls to the direction in which the diameter reduces. In the joint for a fluid container according to the seventh aspect of the present invention, a circular locking groove, which locks the plurality of bails, is provided to the header portion of the plug, thereby releasably connecting the dispenser to the container.

For example, the ball retainer is configured with a portion of the socket main body. The plurality of balls is held between the ball retainer and the sleeve. The ball retainer and the sleeve may be coupled to each other with a clip ring to avoid separation thereof. Moreover, a step is provided to the external wall of the socket main body, and this step is surrounded by the sleeve, thereby making it possible to accommodate, in the step, the slide ring and a helical compression spring that biases the slide ring.

A portion of the plurality of balls usually protrudes from each of the fitting holes. When the socket main body is inserted into the plug, the plurality of balls is guided by the respective fitting holes to retract. In conjunction with the retracting of the plurality of balls, the slide ring also retracts. When the slide ring retracts a predetermined distance, the plurality of balls move to the space from which the slide ring has evacuated. That is, the plurality of balls moves to the direction in which the diameter increases, and a portion of the plurality of balls evacuates from each of the fitting holes. When arriving at the circular locking groove, the plurality of balls is biased by the slide ring, and fit into the locking groove in a locked state. It is possible to separate the dispenser from the container by pulling the dispenser with a strong force that causes the plurality of balls to overcome the locking groove.

In this way, the joint for a fluid container according to the seventh aspect of the present invention enables a one-touch connection of the fluid container, without threading the dispenser as in the case of the prior art. It may be safe to say that the joint for fluid container according to the seventh aspect of the present invention achieves a quick connector.

The joint for a fluid container according to the present invention is configured such that the liquid pouring tube having the collar portion can be attached to the mouth portion of the outer container through the plug. This makes it possible to easily attach the liquid pouring tube independent of the force applied by the operator for adjustment. Moreover, the fluid container is configured such that the duct provided in the dispenser can be directly connected to the fluid passage of the liquid pouring tube, thereby making it possible to easily connect the dispenser to the container.

DETAILED DESCRIPTION OF THE INVENTION

In the following, the most preferred embodiments of the present invention are described with reference to the drawings.

Figure 1:
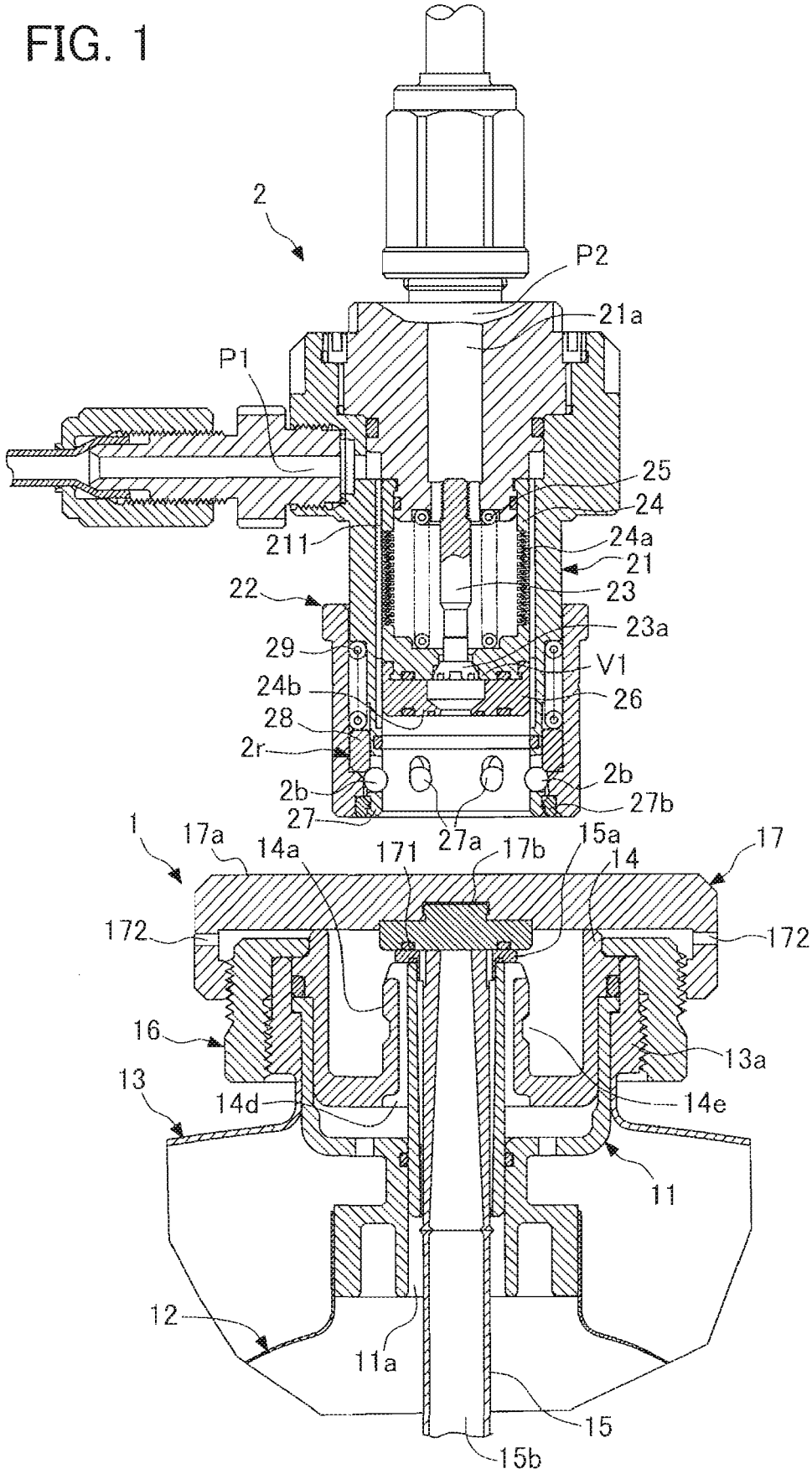
FIG. 1 is a longitudinal section representing an embodiment of a joint for a fluid container of the present invention, showing a top end and a dispenser of the container.
Figure 2:
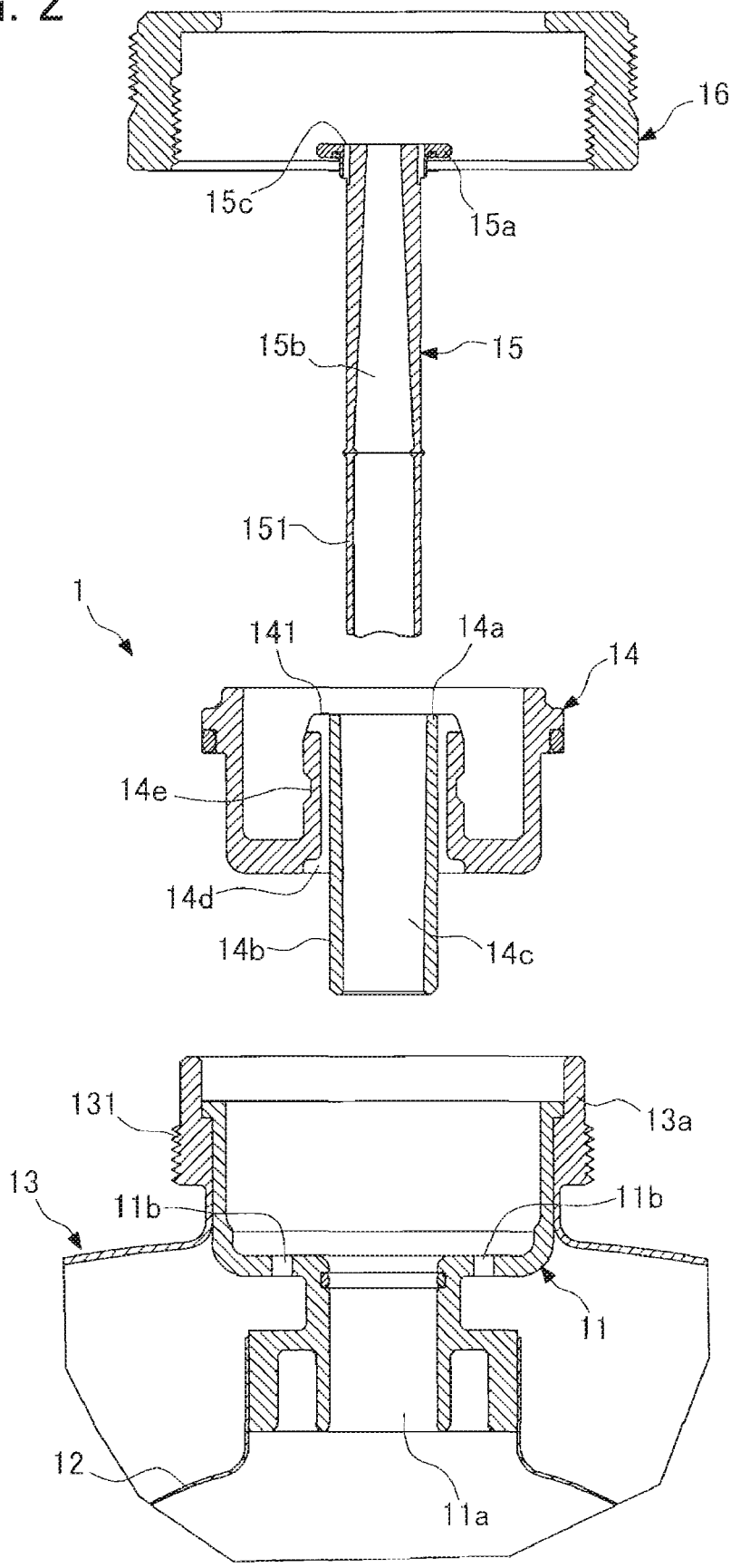
FIG. 2 is a cross-sectional exploded view of the top end of the joint for a fluid container according to the embodiment.
Figure 3:
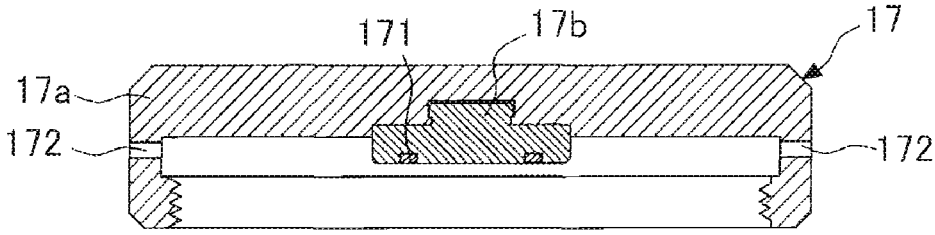
FIG. 3 is a cross-sectional exploded view of the joint for a fluid container according to the embodiment, showing the top end and dispenser of the fluid container.
Figure 3:
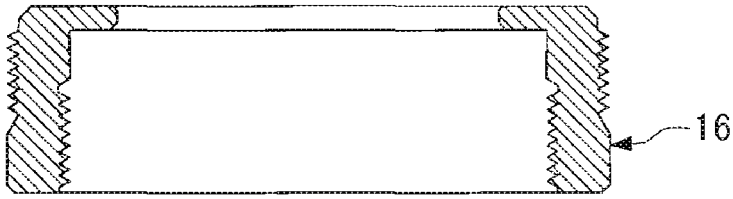
Figure 3:
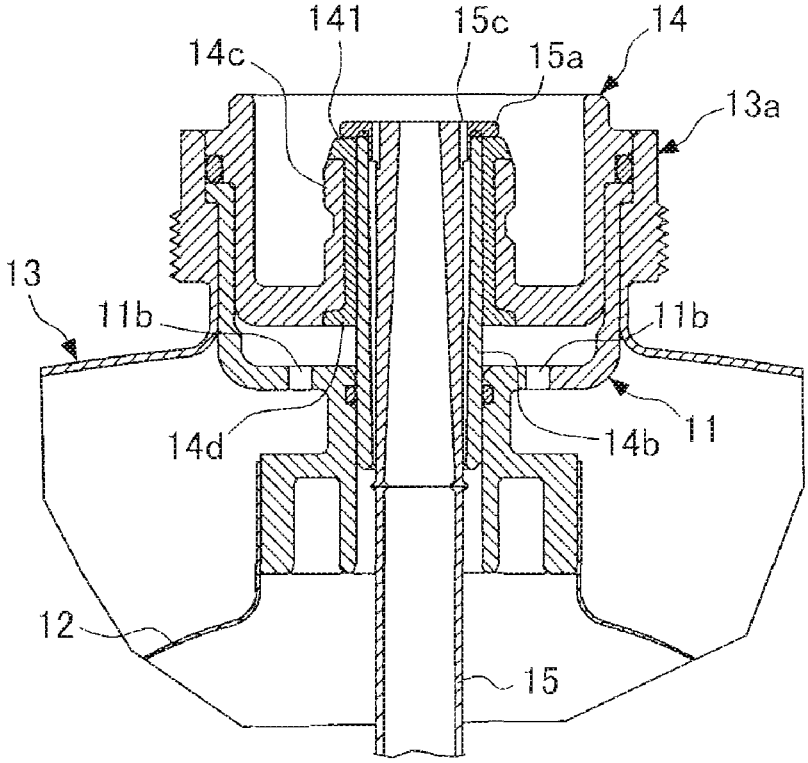
Figure 4:
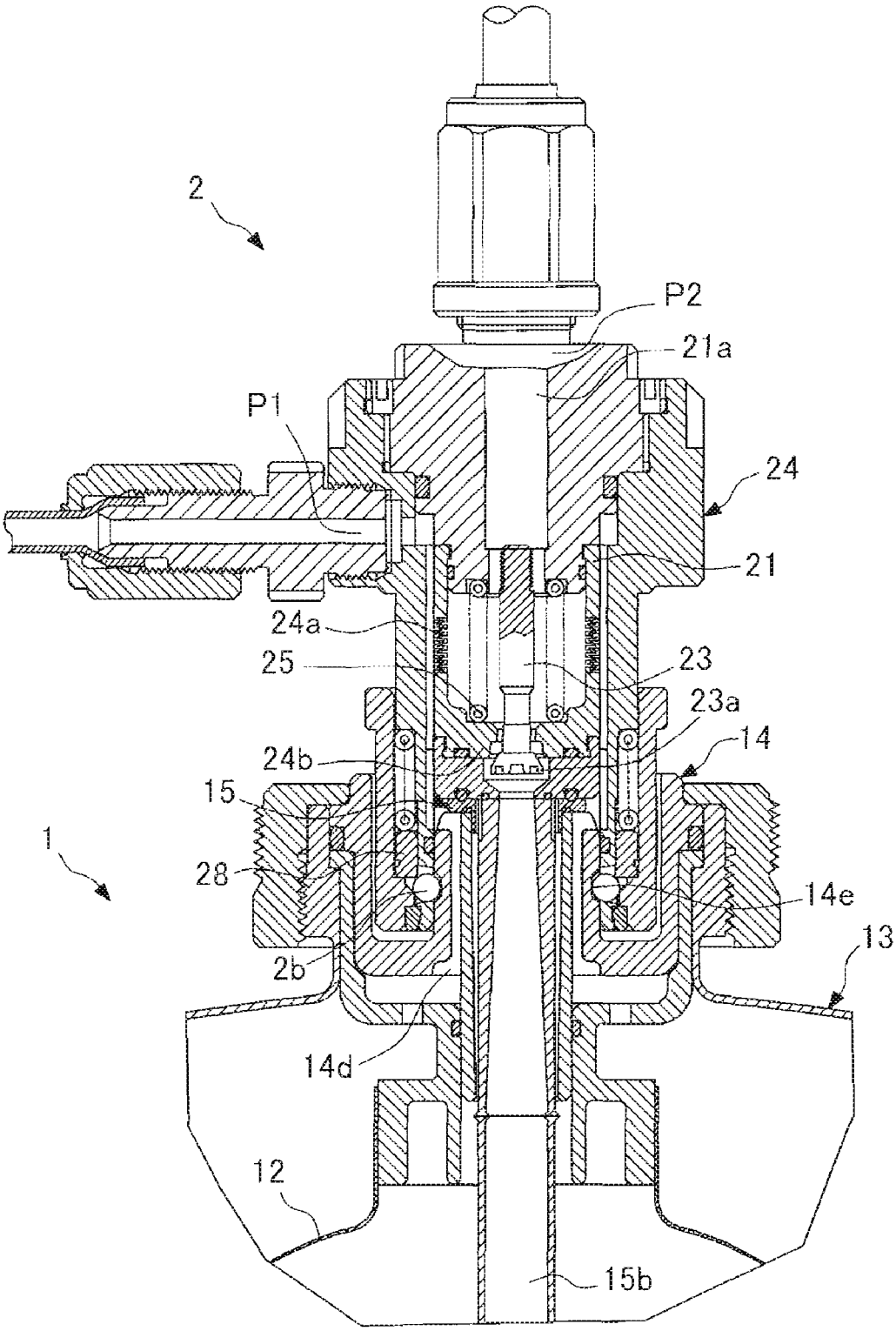
FIG. 4 is a longitudinal section of the joint for a fluid container according to the embodiment, showing an assembled fluid container and dispenser.
Figure 5:
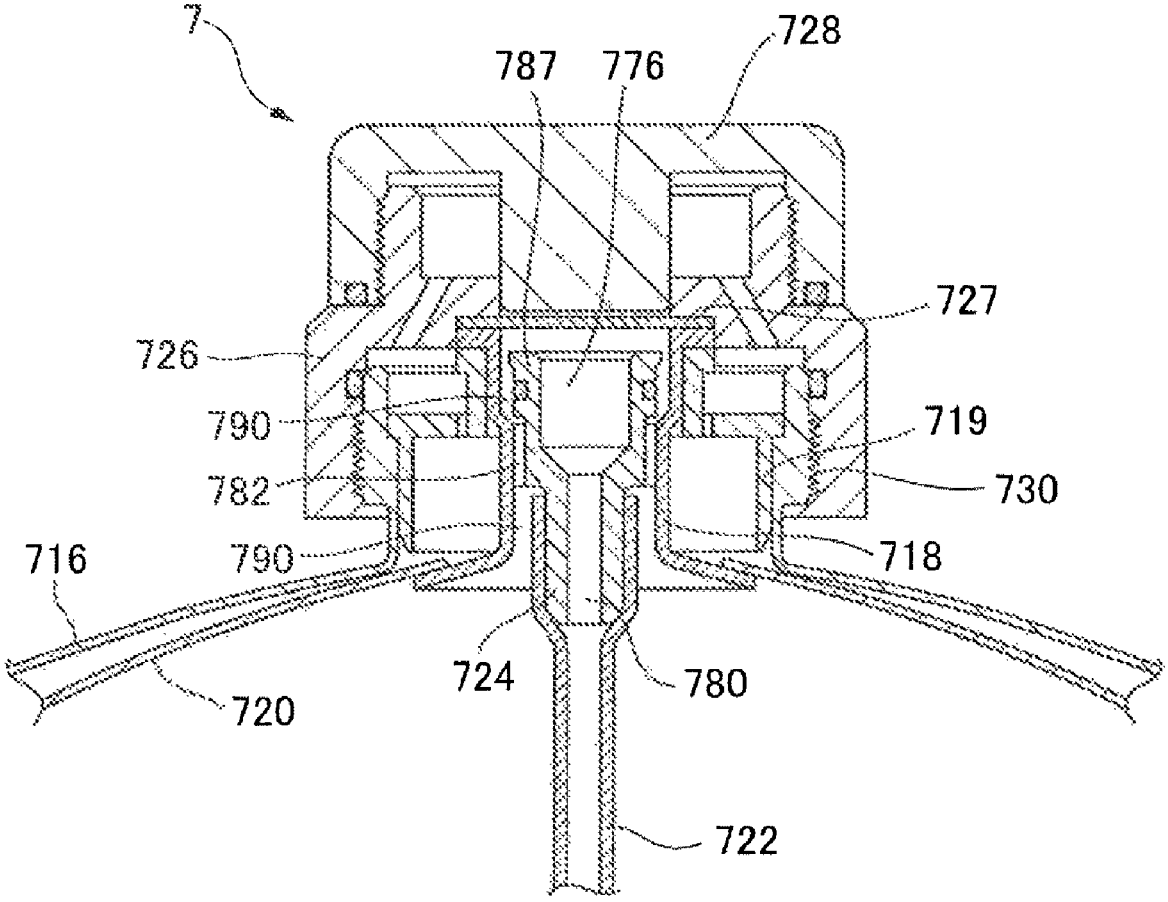
Prior Art FIG. 5
FIG. 5 is a cross-sectional view of the top end of the container according to the prior art, in a state in which a cap is attached.
Figure 6:
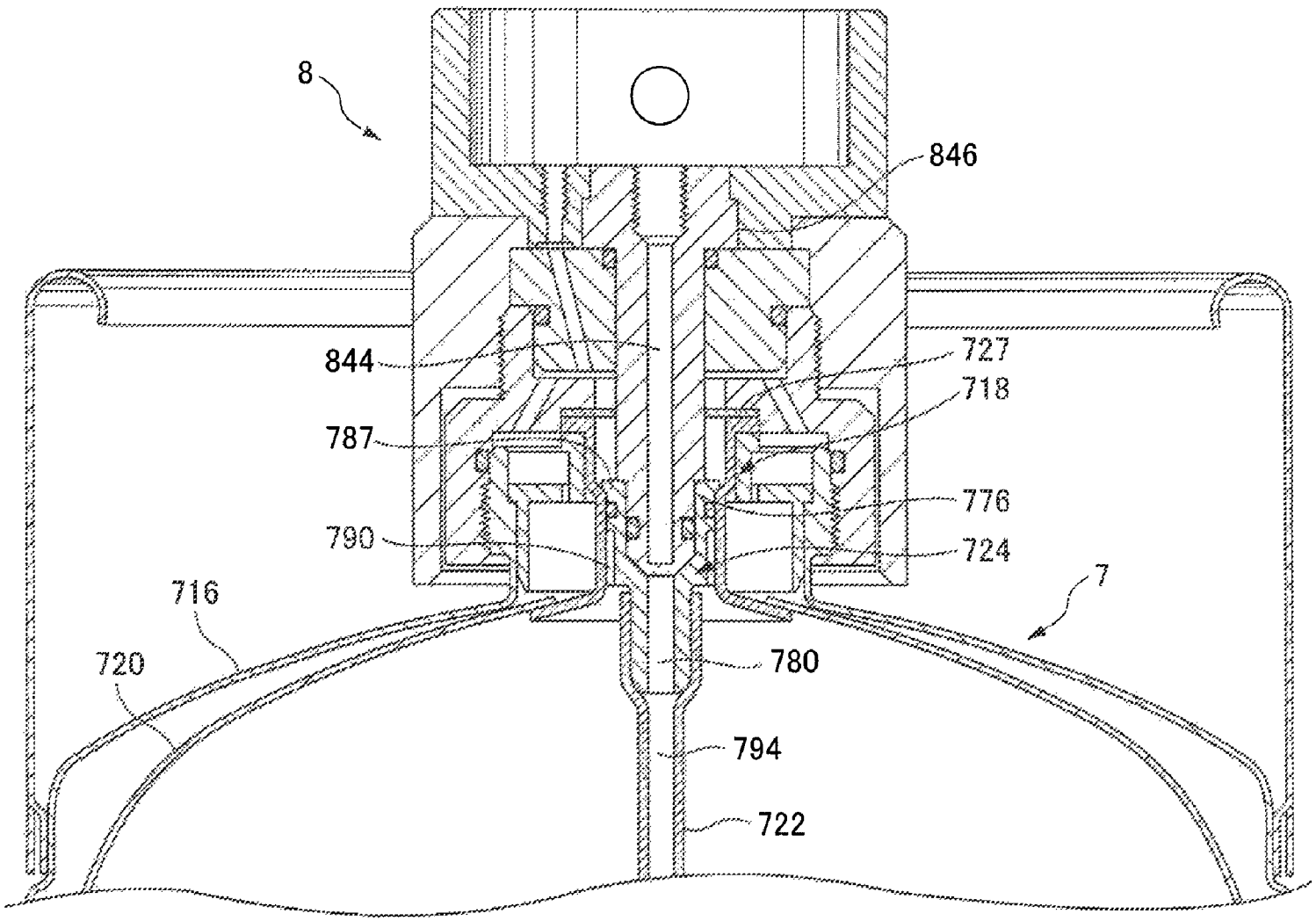
Prior Art FIG. 6
FIG. 6 is a cross-sectional view of the top edge of the container according to the prior art, in a state in which the container and the dispenser are assembled.

FIG. 1 is a longitudinal section representing an embodiment of a joint for a fluid container (hereinafter referred to as a container) of the present invention, showing a top end and a dispenser of the container. FIG. 2 is a cross-sectional exploded view of the top end of the joint for a container according to the embodiment. FIG. 3 is a cross-sectional exploded view of the joint for a container according to the embodiment, showing the top end and the dispenser of the container. FIG. 4 is a longitudinal section of the joint for a container according to the embodiment, showing an assembled container and dispenser.

First, a configuration of a container used in the present, invention is explained. In FIG. 1, a container 1 includes a flexible bag 12 and an outer container 13. The bag 12 has a neck portion 11 that is open for making it possible to pour liquid. The outer container 13 makes it possible to accommodate the bag 12 with the neck portion 11 supported by a mouth portion 13*a*.

In FIG. 1 or FIG. 2, the bag 12 is configured with a pouch of a flexible film formed with an inert material and the neck portion 11 consisting of relatively rigid synthetic resins, in which the neck portion 11 is bonded to an end portion of the pouch of the flexible film. The bag 12 is washed in advance, and is accommodated in the outer container 13. After draining the liquid from the bag 12, the bag 12 with the neck portion 11 is discarded, and a new bag 12 with the neck portion 11 is accommodated in the outer container 13. The fluid container according to the present invention is a dual storage system-type container, in which the outer container is repeatedly used, and in which a new bag is used each time.

In FIG. 1 or FIG. 2, a steel drum is preferably used as the outer container 13, the steel drum being configured with a base plate, a side wall with a ring, and a top plate that bulges in the middle thereof (none of these are shown). As for the outer container 13, an external thread 131 is formed on the mouth portion 13*a*, and a pair of molded handles (not shown) may be provided thereto to facilitate transport.

As shown in FIG. 2, a flange is formed on an orifice side of the neck portion 11, while a step is provided to an inner wall of the mouth portion 13*a*, and this flange engages with the step, thereby supporting the neck portion 11 to the mouth portion 13*a*. The bag 12 is accommodated in the outer container 13, the neck portion 11 attached to the bag 12 is supported by the mouth portion 13*a* of the outer container 13, and thereafter the bag 12 is expanded preferably with nitrogen or compressed air. Subsequently, liquid is poured through an orifice 11*a* of the neck portion 11 into the bag 12 (see FIG. 2).

The container according to the present invention includes a plug 14 and a liquid pouring tube 15 (see FIG. 2). In FIG. 2, the plug 14 is held by the mouth portion 13*a*. Moreover, the plug 14 has a substantially cylindrical header portion 14*a* in a first end, and has a cylindrical portion 14*b* in a second end. In addition, the plug 14 has a through hole 14*c* penetrating from the first end to the second end. The header portion 14*a* protrudes from a base of the plug 14. The cylindrical portion 14*b* fits in the orifice of the neck portion 11 (see FIG. 3).

In FIG. 2, the liquid pouring tube 15 has, in the first end thereof, a collar portion 15*a* adhered to a top face 141 of the header portion 14*a*. Moreover, the second end of the liquid pouring tube 15 is inserted into the through hole 14*c* of the plug 14. The liquid pouring tube 15 has a fluid passage 15*b* extending from the first end to the second end, and the liquid in the bag 12 is drained through the fluid passage 15*b* (see FIG. 1).

In FIG. 2, the external diameter of the plug 14 is slightly smaller than the inner diameter of the neck portion 11, and the plug 14 fits in the neck portion 11 supported by the mouth portion 13*a* (see FIG. 3). A flange, which has an external diameter which is slightly smaller than the inner diameter of the mouth portion 13*a*, is provided to a first end of the plug 14, and an O-ring is supported by this flange, thereby sealing the mouth portion 13*a* (see FIG. 3).

A cover 16 is fastened to the mouth portion 13*a*, thereby holding the plug 14 in the mouth portion 13*a* together with the neck portion 11 (see FIG. 1). A predetermined gap is provided between a bottom external wall of the plug 14 and a bottom inner wall of the mouth portion 13*a*. As a result, it is possible to ventilate gas between a plurality of first orifices 11*b* provided at the bottom of the neck portion 11 and a plurality of second orifices 14*d* provided to the plug 14 (see FIG. 2).

In FIG. 2, the cylindrical portion 14*b* protrudes from the bottom of the plug 14, and the cylindrical portion 14*b* fits in the orifice 11*a* of the neck portion 11. An O-ring is supported inside the orifice 11*a* of the neck portion 11, and this O-ring adheres to the outer perimeter of the cylindrical portion 14*b*, thereby making it possible to seal the gas in the bag 12 (see FIG. 3). The through hole 14*c* penetrates from the top edge of the header portion 14*a* to the bottom edge of the cylindrical portion 14*b*, and the liquid pouring tube 15 is inserted into the through hole 14*c* (see FIG. 3). In order to make it possible to ventilate gas through a plurality of third orifices 15*c*, a gap is provided between the through hole 14*c* and the outer perimeter of the liquid pouring tube 15 (see FIG. 3).

The joint for a container according to the present invention includes a first ventilating means for ventilating air from the inside of the outer container 13 to the mouth portion 13*a*; a second ventilating means for ventilating air from the inside of the bag 12 to the mouth portion 13*a*; and a sealing means for sealing the mouth portion 13*a*. In FIG. 2, the first ventilating means has the plurality of first orifices 11*b* and the plurality of second orifices 14*d*. The plurality of first orifices 11*b* is provided at the bottom of the neck portion 11 and communicates the inside of the outer container 13 to the inside of the neck portion 11. The plurality of second orifices 14*d* communicates the perimeter of the cylindrical portion 14*b* to the top face 141 of the header portion 14*a*. The second ventilating means has the plurality of third orifices 15*c*. The plurality of third orifices 15*c* is provided to the collar portion 15*a* of the liquid pouring tube 15, and communicates the mouth portion 13*a* to the inside of the through hole 14*c* of the plug 14 (see FIG. 3).

The joint for a container according to the present invention prevents, when the sealing means is attached thereto, both liquid and gas from flowing out of the mouth portion 13*a*. Moreover, when the sealing means is removed, the liquid in the outer container 13 and the gas in the bag 12 escape through the first and second ventilating means, respectively, to the outside, before the liquid in the liquid pouring tube 15 is drained to the mouth portion 13*a*.

As shown in FIG. 2, the first orifices lib are through holes formed at the bottom of the neck portion 11, and are provided around the orifices 11*a* of the neck portion 11 into which the cylindrical portion 14*b* is inserted. The first orifices 11*b* substantially communicate the internal space of the outer container 13 to the gap provided between the plug 14 and the mouth portion 13*a* (see FIG. 3). The second orifices 14*d* may be slits penetrating from the perimeter of the cylindrical portion 14*b* to the top face 141 of the header portion 14*a*, and are provided between the cylindrical portion 14*b* and the header portion 14*a*. The second orifices 14*d* substantially communicate the gap, which is provided between the plug 14 and the neck portion 11, to atmospheric air (see FIG. 3).

As shown in FIG. 2, the third orifices 15*c* are through holes formed at the collar portion 15*a* of the liquid pouring tube 15, and penetrate from the top surface of the collar portion 15*a* to the perimeter of the tube. In FIG. 2, the O-ring is supported on the under surface of the collar portion 15*a*, and this O-ring adheres to the top face 141 of the header portion 14*a*, thereby sealing the through hole 14*c*. The third orifices 15*c* substantially communicate the gap, which is provided between the inner wall of the through hole 14*c* and the external wall of the liquid pouring tube 15, to atmospheric air (see FIG. 3). As explained above, this gap can ventilate the internal space of the bag 12.

In FIG. 1 and FIG. 3, the sealing means is a cap 17 threading to the cover 16 that is provided to the mouth portion 13*a*, and the cap 17 consists of a cap body 17*a*, which threads to the cover 16 and which has a light blocking effect, and a bushing 17*b*, which protrudes to the inside of the cap body 17*a* and has corrosion resistance. The bushing 17*b* includes an O-ring 171, which adheres to the surface of the collar portion 15*a* and seals ventilation from the fluid passage 15*b*.

In FIG. 1, the cap body 17*a* consists of a metal body, and a female screw threaded to the cover 16 is provided to the inner circumference of the cap body 17*a*. When the cap 17 is closed, the inner wall of the cap body 17*a* abuts the top face of the plug 14. The cap body 17*a* has a light blocking effect so that chemicals accommodated in the bag 12 do not chemically change. Since there is a high possibility for the bushing 17*b* to contact with the chemicals accommodated in the bag 12, it is preferable that the bushing 17*b* consist of synthetic resins with corrosion resistance. A first end of the bushing 17*b* is pressed into the cap body 17*a*, thereby integrating the bushing 17*b* and the cap body 17*a* (see FIG. 3). A second end of the bushing 17*b* protrudes to the inside of the cap body 17*a*, thereby supporting the O-ring 171 on the apical surface. The O-ring 171 adheres to the surface of the collar portion 15*a*, thereby preventing both the liquid and gas from flowing out of the fluid passage 15*b*.

Moreover, at least one vent hole 172 is provided to the perimeter of the cap body 17*a*. Accordingly, when the threads with the cover 16 are released, the gas in the outer container 13 and the gas in the bag 12 escape through the first and second ventilating means, respectively, to the outside of the mouth portion 13*a*, before the liquid in the liquid pouring tube 15 is drained to the mouth portion 13*a* (see FIG. 1 or FIG. 3). In this way, the vent holes 172 are provided to the perimeter of the cap body 17*a*. Accordingly, when the cap 17 is loosened, the adhesion of the O-ring 171 to the surface of the collar portion 15*a* is released, thereby exhausting the gas in at least the plurality of third orifices 15*c* through the vent holes 172 to the outside. This makes it possible to prevent the liquid in the liquid pouring tube 15 from spouting out.

In FIG. 1, when the cap 17 is removed, the gas in the outer container 13 and the gas in the bag 12 escape through the first and second ventilating means, respectively, to the outside of the mouth portion 13*a*, before the liquid in the liquid pouring tube 15 is drained to the mouth portion 13*a*. This makes it possible to prevent the liquid in the liquid pouring tube 15 from being drained to the outside of the mouth portion 13*a*.

In the joint for a container according to the present invention, the gas in the liquid pouring tube 15, the gas in the outer container 13, and the gas in the bag 12 are individually sealed by the cap 17. When the cap 17 is removed, the pressure in the liquid pouring tube 15, the pressure in the outer container 13, and the pressure in the bag 12 promptly equilibrate with atmospheric pressure. This makes it possible to prevent the liquid in the liquid pouring tube 15 from being drained to the outside of the mouth portion 13*a*.

Moreover, as shown in FIG. 2, the liquid pouring tube 15 joins a tube 151 in the middle from the first end having the collar portion 15*a* to the second end. It is possible to heat weld the liquid pouring tube 15 to the tube 151 in the middle from, the first end having the collar portion 15*a* to the second end, by means of ultrasonic oscillation. In the case of the joint, for a container according to the present invention, the liquid pouring tube 15 is integrated into the main body. This makes it possible to save the trouble of eliminating chemicals seeping into the gaps of press fit points of the liquid pouring tube as a conventional separate body.

In the case of the joint for a container according to the present invention, it is possible to distribute the liquid in the container by removing the cap and connecting the dispenser. In FIG. 1, a dispenser 2 includes a socket main body 21, a valve mechanism V1, and a sleeve 22. The socket main body 21 has a cylindrically shaped outer cylinder. The valve mechanism V1 is constructed inside the socket main body 21, and intermittently causes the duct 21*a* to axially penetrate. The sleeve 22 is held on the outer perimeter of the orifice side of the socket main body 21. Moreover, the sleeve has a releasably lockable locking mechanism 2*r* so as to cover the header portion 14*a*. In addition, the dispenser 2 includes a means to receive liquid distributed from the bag 12 through the fluid passage 15*b* of the liquid pouring tube 15 and the duct 21*a* of the valve mechanism V1, in which the valve mechanism V1 is biased to and adheres to the first end of the liquid pouring tube 15 (see FIG. 4).

In FIG. 1, the valve mechanism V1 includes a valve 23 arranged in the duct 21*a*, an inner sleeve 24, a helical compression spring 25, and a coupling seat 26. The valve 23 is arranged in the duct 21*a* and has a valve 23*a* at the tip end, and the bottom is fixed to the socket main body 21. Regarding the inner sleeve 24, the inside forms a portion of the duct 21*a*, and a shank 24*a* forms a retractable bellows. A second end of the inner sleeve 24 has a seat portion 24*b* that makes the valve 23*a* open and close, and a second end of the inner sleeve 24 is fixed to the socket main body 21. The helical compression spring 25 applies a force so that the inner sleeve 24 extends. The coupling seat 26 bonds to the side of the seat portion 24*b* of the inner sleeve 24, and is biased to and adheres to the first end of the liquid pouring tube 15. The locking mechanism 2*r* may be, as described later, a so-called ball catch using balls 2*b* as a locking element, and the sleeve 22 releasably engages with the header portion 14*a* of the plug 14 so as to cover it (see FIG. 4).

As shown in FIG. 1, regarding the dispenser 2, the duct 21*a* in the valve mechanism V1 is usually blocked with the seat portion 24*b* abutting the valve 23*a*. When the socket main body 21 is inserted into the plug 14, the valve mechanism V1 is biased to the first end of the liquid pouring tube 15 and adheres to the top face of the liquid pouring tube 15. In addition, when the socket main body 21 is inserted, the seat portion 24*b* separates from the valve 23*a*, whereby the duct 21*a* in the valve mechanism V1 becomes passable (see FIG. 4). In a state where the sleeve 22 is locked to the header portion 14*a*, the fluid passage 15*b* of the liquid pouring tube 15 couples directly to the duct 21*a* of the valve mechanism V1, thereby making it possible to receive liquid distributed from the bag 12.

The joint for a fluid container according to the present invention does not use the breakable seal shown in Patent Document 1. Therefore, it is possible to avoid a case in which the probe provided to the dispenser breaks through the seal, causing fractured seal pieces to mix into the bag. Moreover, a concern is eliminated regarding a case in which an operator can not properly break through the seal, causing clogging of the probe, disabling the connection. In this way, the joint for a container according to the present invention achieves a joint structure with which the dispenser is connected to the container, without the use of the breakable seal.

In FIG. 1, the dispenser 2 communicates with the second orifices 14*d* of the first ventilating means (see FIG. 4), and a gas passage 211, to which pressurized fluid is supplied, is provided between the socket main body 21 and the valve mechanism V1. The gas passage 211 is a plurality of slits formed in the inner wall of the outer cylinder of the socket main body 2. Regarding these slits in a locked state, a first end of each communicates with the second orifices 14*d* of the first ventilating means, and the second end of each is connected to a supply port P1 provided to the dispenser 2. When a pressurized fluid is supplied between the bag 12 and the outer container 13 through the gas passage 211, the bag 12 shrinks and the liquid is distributed from the bag 12 to a discharge port P2 through the fluid passage 15*b* of the liquid pouring tube 15 and the duct 21*a* of the valve mechanism V1.

In FIG. 1, the locking mechanism 2*r* includes the plurality of balls 2*b*, a ball retainer 27, and a slide ring 28. The plurality of balls 2*b* is arranged in the inner circumference of the orifice side of the sleeve 22. The ball retainer 27 holds the plurality of balls 2*b*. Moreover, the ball retainer 27 is provided with a plurality of fitting holes 27*a* permitting only movement in which the plurality of balls 2*b* move axially as well as move outward and inward in the outer perimeter direction. The slide ring 28 is arranged between the socket main body 21 and the sleeve 22. The slide ring 28 biases the plurality of balls 2*b* to the orifice side of the sleeve 22, thereby pressing the plurality of balls 2*b* to the direction in which the diameter reduces. A circular locking groove 14*e*, which locks the plurality of balls 2*b*, is provided to the header portion 14*a* of the plug 14, thereby releasably connecting the dispenser 2 to the container 1.

In FIG. 1, the ball retainer 27 is configured with a portion of the socket main body 21. The plurality of balls 2*b* is held between the ball retainer 27 and the sleeve 22. The ball retainer 27 and the sleeve 22 are coupled to each other with a clip ring 27*b* to avoid separation thereof. Moreover, a step is provided to the external wall of the socket main body 21, and this step is surrounded by the sleeve 22, thereby making it possible to accommodate, in the step, the slide ring 28 and a helical compression spring 29 that biases the slide ring 28.

As shown in FIG. 1, a portion of the plurality of balls 2*b* usually protrudes from each of the fitting holes 27*a*. When the socket main body 21 is inserted into the plug 14, the plurality of balls 2*b* is guided by the respective fitting holes 27*a* to retract. In conjunction with the retracting of the plurality of balls 2*b*, the slide ring 28 also retracts. When the slide ring 28 retracts a predetermined distance, the plurality of balls 2*b* move to the space from which the slide ring 28 has evacuated. That is, the plurality of balls 2*b* move to the direction in which the diameter increases, and a portion of the plurality of balls 2*b* evacuates from each of the fitting holes 27*a*. When arriving at the circular locking groove 14*e*, the plurality of balls 2*b* is biased by the slide ring 28, and fit into the locking groove 14*e* in a locked state (see FIG. 4). It is possible to separate the dispenser 2 from the container 1 by pulling the dispenser 2 with a strong force that causes the plurality of balls 2*b* to overcome the locking groove 14*e*.

In this way, the joint for a fluid container according to the present invention enables a one-touch connection of the fluid container, without threading the dispenser as in the case of the prior art. It may be safe to say that the joint for a fluid container according to the present invention achieves a quick connector.

What is claimed is:

1. A joint for a fluid container to which a dispenser is connected, the container having a flexible bag having a neck portion that is open for pouring liquid; and an outer container that supports the neck portion with a mouth portion and that accommodates the bag, the fluid container comprising:

a cylindrical plug held by the mouth portion, the cylindrical plug having a substantially cylindrical header portion protruding from a cylindrical bottom at a first end, a cylindrical portion fitting into an orifice of the neck portion at a second end, and a through hole penetrating from the first end to the second end;

a liquid pouring tube having a collar portion fixed to a top face of the header portion at a first end, with a second end being inserted into the through hole, wherein the liquid pouring tube has a fluid passage extending from the first end to the second end, and wherein liquid in the bag is drained through the fluid passage;

a first ventilating means for ventilating gas from an inside of the outer container to the mouth portion, wherein the first ventilating means has a plurality of first orifices provided to a bottom of the neck portion, the plurality of first orifices communicating from an inside of the outer container to an inside of the neck portion, and has a plurality of second orifices communicating from a perimeter of the cylindrical portion to the top face of the header portion; and a second ventilating means for ventilating gas from the inside of the bag to the mouth portion, wherein the second ventilating means has a plurality of third orifices provided to the collar portion, the plurality of third orifices communicating from the mouth portion to an inside of the through hole, the dispenser comprising:

a socket main body having a cylindrical outer cylinder;

a valve mechanism which is configured inside the socket main body, and which causes an axially penetrating duct to be discontinuous;

a sleeve, which is held around an outer perimeter of an orifice side of the socket main body, and which has a releasably lockable locking mechanism to cover the header portion; and a means for receiving liquid distributed from the bag through a fluid passage of the liquid pouring tube and the duct of the valve mechanism, wherein the valve mechanism is biased to and adheres to the first end of the liquid pouring tube.

2. The joint for a fluid container according to claim 1, wherein the liquid pouring tube joins a tube in the middle from the first end having the collar portion to the second end.

3. The joint for a fluid container according to claim 1, wherein a toric cover is threaded into the mouth portion, the toric cover holding the neck portion and the plug to the mouth portion.

4. The joint for a fluid container according to claim 1, further comprising the dispenser which communicates with a second orifice of the first ventilating means, and a gas passage, to which a pressurized fluid is supplied, that is provided between the socket main body and the valve mechanism.

5. The joint for a fluid container according to claim 4, wherein when a pressurized fluid is supplied between the bag and the outer container through the gas passage, the bag shrinks and liquid is distributed from the bag through a fluid passage of the liquid pouring tube and the duct of the valve mechanism.

6. The joint for a fluid container according to claim 1, wherein the valve mechanism comprises:

a valve body which is arranged in the duct, and which has a valve at a tip end thereof, and the bottom is fixed to the socket main body;

an inner sleeve, wherein an inside forms a portion of the duct, a shank forms a retractable bellows, a first end has a seat portion open and closable by the valve, and a second end is fixed to the socket main body;

a helical compression spring, which is arranged inside the inner sleeve, and applies a force to extend the inner sleeve; and a coupling seat, which bonds to a seat portion side of the inner sleeve, and is biased to and adheres to the first end of the liquid pouring tube.

7. The joint for a fluid container according to claim 1, wherein the locking mechanism further comprises:

a plurality of balls that are arranged in an inner circumference of an orifice side of the sleeve;

a ball retainer for holding the plurality of balls, which are provided with a plurality of fitting holes permitting only movement in which the plurality of balls move axially and move outward and inward in an outer perimeter direction; and a slide ring, which is arranged between the socket main body and the sleeve, and biases the plurality of balls to the orifice side of the sleeve, thereby pressing the plurality of balls to a direction in which the diameter reduces, and wherein a circular locking groove, which locks the plurality of balls, is provided to the header portion of the plug, thereby releasably connecting the dispenser to the container.

* * * * *